US012221782B2

(12) United States Patent
Kamei

(10) Patent No.: US 12,221,782 B2
(45) Date of Patent: Feb. 11, 2025

(54) SECONDARY DRAINAGE METHOD AT TIME OF FLOODING

(71) Applicant: Masamichi Kamei, Tokyo (JP)

(72) Inventor: Masamichi Kamei, Tokyo (JP)

(73) Assignee: LAND BUSINESS CO., LTD., Tokyo (JP)

( * ) Notice: Subject to any disclaimer, the term of this patent is extended or adjusted under 35 U.S.C. 154(b) by 118 days.

(21) Appl. No.: 17/757,318

(22) PCT Filed: Dec. 15, 2020

(86) PCT No.: PCT/JP2020/046762
§ 371 (c)(1),
(2) Date: Jun. 14, 2022

(87) PCT Pub. No.: WO2021/125170
PCT Pub. Date: Jun. 24, 2021

(65) Prior Publication Data

US 2023/0019458 A1 Jan. 19, 2023

(30) Foreign Application Priority Data

Dec. 20, 2019 (JP) ..... 2019-230121

(51) Int. Cl.
*E03F 3/02* (2006.01)
*E03F 1/00* (2006.01)
*E03F 5/14* (2006.01)

(52) U.S. Cl.
CPC ..... *E03F 3/02* (2013.01); *E03F 1/002* (2013.01); *E03F 5/14* (2013.01)

(58) Field of Classification Search
CPC ..... E03F 3/02; E03F 1/002; E03F 5/14
(Continued)

(56) References Cited

U.S. PATENT DOCUMENTS 6,382,237 B1 5/2002 Takai
10,526,776 B1 * 1/2020 McNeill ..... E03F 5/10
2010/0260547 A1 10/2010 Niemczyk

FOREIGN PATENT DOCUMENTS

JP S57-201081 A 12/1982
JP 59-098974 U1 7/1984
(Continued)

OTHER PUBLICATIONS

Translation of Honda (JP_5202210_B2) (Year: 2024).*
(Continued)

*Primary Examiner* — Ekandra S. Miller-Cruz
(74) *Attorney, Agent, or Firm* — Chrisman Gallo Tochtrop LLC

(57) ABSTRACT

The present application provides a secondary drainage method for use at the time of flooding. A rainwater storage tank is provided, drainage pipes are installed between positions in which flooding of land or of property occurs and the rainwater storage tank, and inflow switching valves are installed in portions where water flows in from the drainage pipes to the rainwater storage tank. As a general rule, the flow of water into the rainwater storage tank is prevented by switching the inflow switching valves during the initial stages of a localized severe rain storm or of river flooding. After the wide-area flooding of land has receded, the inflow switching valves are opened, guiding the water in the locally remaining zones of flooded land or of flooded property into the rainwater storage tank, and allowing the localized flooding of land or of property to be eliminated at an early stage.

14 Claims, 2 Drawing Sheets

(58) Field of Classification Search
USPC ..... 210/747.3
See application file for complete search history.

(56) References Cited

FOREIGN PATENT DOCUMENTS

| | | | | |
|---|---|---|---|---|
| JP | H11-061953 | A | 3/1999 | |
| JP | 2000-213015 | A | 8/2000 | |
| JP | 2001-000960 | A | 1/2001 | |
| JP | 2005-016125 | A | 1/2005 | |
| JP | 2009-287197 | A | 12/2009 | |
| JP | 2010-077623 | A | 4/2010 | |
| JP | 2012-149560 | A | 8/2012 | |
| JP | 5202210 | B2 * | 6/2013 | ..... E03B 11/14 |
| JP | 2014-152728 | A | 8/2014 | |
| JP | 2015-158126 | A | 9/2015 | |
| JP | 2016-079635 | A | 5/2016 | |
| JP | 2016-89378 | A | 5/2016 | |
| KR | 10-1301042 | B1 | 8/2013 | |

OTHER PUBLICATIONS

International Search Report issued in corresponding International Application No. PCT/JP2020/046762 mailed Feb. 2, 2021.
Written Opinion issued in corresponding International Application No. PCT/JP2020/046762 dated Feb. 2, 2021.
Extended European Search Report issued in corresponding application, EP 20 90 3686.2, dated Jan. 2, 2024.

* cited by examiner

SECONDARY DRAINAGE METHOD AT TIME OF FLOODING

CROSS-REFERENCE TO RELATED APPLICATIONS

This application is a U.S. National Stage entry of PCT/JP2020/046762, filed Dec. 15, 2020, which claims benefit of priority to Japanese application 2019-230121, filed Dec. 20, 2019, the entire disclosures of which are hereby incorporated herein by reference.

TECHNICAL FIELD

This invention relates to a secondary drainage method for use at the time of flooding to eliminate problems that cultivated fields and/or roads and houses and/or buildings remain flooded for a long time as the result of the occurrence of a localized severe rain storm or that of a bank collapse by flooding or the like.

BACKGROUND ARTS

There have been frequent floodings beyond an expected level owing to the unusual weather in recent years. Meanwhile, as one measure to prevent widespread flooding, the flow control of underground rivers and/or the development of rainwater control reservoirs have been improved, resulting in a fairly good achievement.

In regards to measures against flooding caused by a localized severe rain storm, many communities in Japan have been required to take measures to suppress the outflow of rainwater to be about 600 $m^3$ per hectare, and in this connection, there has been provided a rainwater control reservoir as one of the measures.

However, although the flow control of underground rivers and/or the development of rainwater control reservoirs has made a good contribution to control of widespread flooding, it is not uncommon that in some communities, there has arisen problems that flooding of land or of property remains locally for a long time ranging from several days to several weeks, thereby imposing a heavy burden on local residents due to the occurrence of troubles such as blockage of traffics in flooded sections.

As one rainwater drainage control system which is simply constructable at low cost, the following patent document 1 discloses a rainwater drainage control system for storing rainwater in a rainwater storage tank during a larger amount of rainfall than a predetermined level, and for draining rainwater without storing during a rainfall in any other case, wherein the rainwater drainage control system has a rainwater collection equipment, a rainwater conveyance passage for introducing the rainwater from the rainwater collection equipment to the rainwater storage tank, a rainwater drainage passage for introducing the rainwater from the rainwater collection equipment to a drainage facility, and a diversion control unit for switching connection between the rainwater conveyance passage or the rainwater drainage passage and the rainwater collection equipment at the time of the larger amount of rainfall than the predetermined level and at the time of the rainfall in any other case.

As one underground water storage tank which enables water stored in a flood control reservoir to be effectively utilized as raw water, and also enables the stored water to be successively purified and stored, the following patent document 2 discloses an underground water storage tank having a water storage space formed in a position lower than the flood control reservoir, wherein the underground water storage tank has a water supply port provided at the bottom of the flood control reservoir to receive water collected in the flood control reservoir, a filter member attached to the water supply port to filtrate the received water for purification, a water storage tank body that constitutes the water storage space to store the purified water generated by the filter member, and a drainage means for draining the purified water stored in the water storage tank body.

As one playground drainage structure which enables rainwater to be speedily drained from a playground surface, and also enables the rainwater to be prevented from remaining on the playground surface for a long time, even after torrential downpours with a huge amount of rainfall in a short time, like a localized severe rain storm, the following patent document 3 discloses a playground drainage structure constituted of a permeable surface layer, a rainwater storage and permeation tank constituted such that a resin material buried under the surface layer is used at least as a structural material, and a communication part for intercommunicating the rainwater storage and permeation tank and a gutter, wherein a side wall of the gutter and an upper part of the rainwater storage and permeation tank are intercommunicated through the communication part, allowing the rainwater to flow into the rainwater storage and permeation tank through the surface layer and also to flow from the gutter into the rainwater storage and permeation tank through the communication part.

As one device and method for injecting surface water into the subsoil to remove a moist condition caused by retained surface water and/or flooding, the following patent document 4 discloses a technique characterized by forming a hole pattern in the ground by drilling, followed by inserting an elongate-shaped water-injection and drainage passage member into each drilled hole in the soil ground, and allowing each hole to receive the water-injection and drainage passage member.

Besides, the following patent document 5 discloses a rainwater flood control and water utilization system constituted of a small-scale storage facility capable of storing water flowing out from a rainwater outflow source, a large-scale storage facility arranged in a land area lower than the small-scale storage facility, the large-scale storage facility being greater in water storage amount than the total water storage amount in a plurality of small-scale storage facilities, and a piping for interconnecting both the small-scale and large-scale storage facilities, and it is stated in this document also that this rainwater flood control and water utilization system has a flood control function applicable even to a situation in which relatively small-scale rainwater infiltration hardly occurs, and enables also the utilization of stored rainwater such as to supply the stored rainwater from the large-scale storage facility arranged in the lowland area to the small-scale storage facilities, or from these facilities to the inside of a dwelling house or to a parking place.

Further, the following patent document 6 discloses a water-injection and drainage equipment of an underground reservoir, wherein a water-injection and drainage machine is interposed in a communication path that is for intercommunicating an underground reservoir formed in the ground and a water receiving part formed on a ground surface, and a power generator is connected to the water-injection and drainage machine, and it is stated in this document also that in a heavy rainfall, an open/close valve is opened, causing the rainwater flowing from the ground surface into the water receiving part to be filtrated with a filter and thereafter enter the communication path, resulting in that a waterwheel of a waterwheel device is rotated for power generation by the force of water hitting the waterwheel.

Furthermore, the following patent document 7 discloses a wide-area catchment type underground water storage tank equipped with a water storage tank having a drainage means that is buried under the ground and is capable of draining water from a ground surface, the water storage tank being constituted so as to enable storage of water, and an intake pipe having one end communicating with the inside of the water storage tank from a side part or an upper part thereof, with the other end opened in the ground surrounding the water storage tank, wherein a check valve is mounted to the intake pipe.

PRIOR ART DOCUMENTS

Patent Documents

Patent document 1: Japanese Unexamined Patent Application Publication No. 2009-287197

Patent document 2: Japanese Unexamined Patent Application Publication No. 2010-077623

Patent document 3: Japanese Unexamined Patent Application Publication No. 2015-158126

Patent document 4: Japanese Unexamined Patent Application Publication No. 2016-089378

Patent document 5: Japanese Unexamined Patent Application Publication No. 2005-016125

Patent document 6: Microfilm of Japanese Utility Model Application No. Sho57-201081 (Japanese Unexamined Utility Model Application Publication No. Sho59-98974)

Patent document 7: Japanese Unexamined Patent Application Publication No. 2000-213015

SUMMARY OF THE INVENTION

Problems to be Solved by the Invention

In reality, because of the fact that localized flooding of land or of property remains in a state of being scattered for a long time even after flooding of land or of property due to a localized severe rain storm, river flooding or the like has receded over a wide area as described above, there arise serious difficulties in daily lives of local residents.

Possible causes of the localized flooding of land or of property include geological stratum conditions such as topography of a flooded region and location of a water-bearing stratum in the ground.

According to an invention as disclosed in the above patent document 4, for instance, it is characterized by forming the hole in the ground by boring to inject the surface water into the ground in order to remove the moist condition caused by flooding or by retained surface water resulting from such geological stratum conditions, in which case, however, an act of forming the hole by boring so as to penetrate the water-bearing stratum without care may cause environmental problems such as pollution of groundwater under the water-bearing stratum and depletion of the groundwater.

An object of the present invention is to provide a secondary drainage method for use at the time of flooding, with which it is possible to eliminate, at an early stage and without causing any environmental problems, localized flooding of land or of property that remains even after flooding of land or of property due to a localized severe rain storm, river flooding or the like has receded over a wide area.

Means for Solving the Problems

A secondary drainage system for use at the time of flooding according to the present invention comprises a rainwater storage tank having inflow switching valves installed in water flowing-in portions to temporarily prevent water from flowing in from the water flowing-in portions, a water guiding means for guiding, into the water storage tank, the water in the locally remaining zones of flooded land or of flooded property even after wide-area flooding of land due to a localized severe rain storm or river flooding has receded, and a drainage means for draining the water stored in the rainwater storage tank.

It is to be understood that an act of temporarily preventing the flow of water into the rainwater storage tank by the inflow switching valves is for permitting the water in the locally remaining zones of flooded land or of flooded property to take in for the sake of secondary drainage for post-treatment, after the flooding of land or of property has receded over a wide area. In other words, this is because when the water generated in a large quantity during flooding or the like is made to flow into the rainwater storage tank as it is, the rainwater storage tank becomes full in a flash so that drainage cannot keep up with such flow of water into the rainwater storage tank, and as a result, it takes a long time until the secondary drainage can be performed.

The rainwater storage tank is preferable to be an underground water storage tank buried in the ground, or alternatively, may be installed on the ground or semi-underground depending on the conditions as well.

Further, a filter means is provided in the front of the rainwater storage tank similarly to a conventional rainwater storage tank, more specifically, the water guiding means or the rainwater storage tank can be provided with a soil-component removing filter means to remove earth and sand or the like contained in the water. However, because of the fact that floodwater remaining even after flooding is in the state of surface water with a soil component settled to a certain degree as compared with muddy water or the like generated immediately after flooding, it is often possible to cope with the remaining floodwater by use of a more simplified rainwater storage tank compared with a common type of rainwater storage tank.

The water guiding means for guiding the water in the locally remaining zones of flooded land or of flooded property into the rainwater storage tank can be, specifically, a means such as a drainage pipe for interconnecting the rainwater storage tank and the locally remaining zones of flooded land or of flooded property, and besides, a water suction pump may be interposed in the water guiding means to forcibly guide the water at an early stage.

Alternatively, instead of the drainage pipe installed under the ground or in combination with the drainage pipe, it may be possible also to use a water sucking hose or like water suction means equipped with a water suction pump for sucking the water in the locally remaining zones of flooded land or of flooded property from a ground surface side.

The drainage means for draining the water stored in the rainwater storage tank can be a means such as a drainage pump and a drainage channel connected to a river or to a sewerage, for instance.

A secondary drainage method for use at the time of flooding according to the present invention represents a secondary drainage method that is for use at the time of flooding and makes use of the secondary drainage system for use at the time of flooding, wherein the flow of water into a rainwater storage tank is prevented by closing inflow switching valves during the initial stages of a localized severe rain storm or of river flooding that occurs in a target region, and wherein after wide-area flooding of land due to the localized severe rain storm or river flooding has receded, the inflow switching valves are opened, guiding the water in the locally remaining zones of flooded land or of flooded property into the rainwater storage tank, followed by draining the water stored in the rainwater storage tank by a drainage means.

It is to be understood that an act of preventing the flow of water into the rainwater storage tank by closing the inflow switching valves is for permitting the water in the locally remaining zones of the flooded land or of flooded property to take in for the sake of secondary drainage for post-treatment, after the flooding of land or of property has receded over a wide area. In other words, this is because when the water generated in a large quantity during flooding or the like is made to flow into the rainwater storage tank as it is, the rainwater storage tank becomes full in a flash so that drainage cannot keep up with such flow of water into the rainwater storage tank, and as a result, it takes a long time until the secondary drainage can be performed.

As another mode of the secondary drainage method for use at the time of flooding according to the present invention, there may be provided a secondary drainage method for use at the time of flooding, wherein the flow of water into a rainwater storage tank is partly permitted, while being suppressed by switching of inflow switching valves during the initial stages of a localized severe rain storm or of river flooding that occurs in a target region, and wherein after wide-area flooding of land due to the localized severe rain storm or river flooding has receded, the inflow switching valves are opened, guiding the water in the locally remaining zones of flooded land or of flooded property into the rainwater storage tank, followed by draining the water stored in the rainwater storage tank by a drainage means.

When thanks to weather forecast information, a certain level of flooding due to a rainfall is preliminarily anticipated to occur in surrounding areas of the target region, it can be considered that not only the utilization of the secondary drainage system for use at the time of flooding according to the present invention as a system of secondary drainage for post-treatment, but also an act of partly permitting the flow of water into the rainwater storage tank for the purpose of reducing a water level in the surrounding areas of the target region is made to contribute to suppression of the flooding in the surrounding areas as much as possible, provided that a rainfall amount is not more than a certain level.

In this case, it may be possible also to perform switching between the opened and closed states of the inflow switching valves automatically in linkage with the weather forecast information.

Further, the inside of the rainwater storage tank may be divided into two or more parts to serve as a storage part for use at times during rainfall and that only for secondary drainage use in principle.

Effect of the Invention

With the secondary drainage method for use at the time of flooding according to the present invention, it is possible to eliminate, at an early stage and without any environmental problems, flooding of land or of property that locally remains even after flooding of land or of property due to a localized severe rain storm, river flooding or the like has receded over a wide area.

MODE FOR EMBODYING THE INVENTION

Hereinafter will be described the present invention with reference to the attached drawings.

Figure 1:
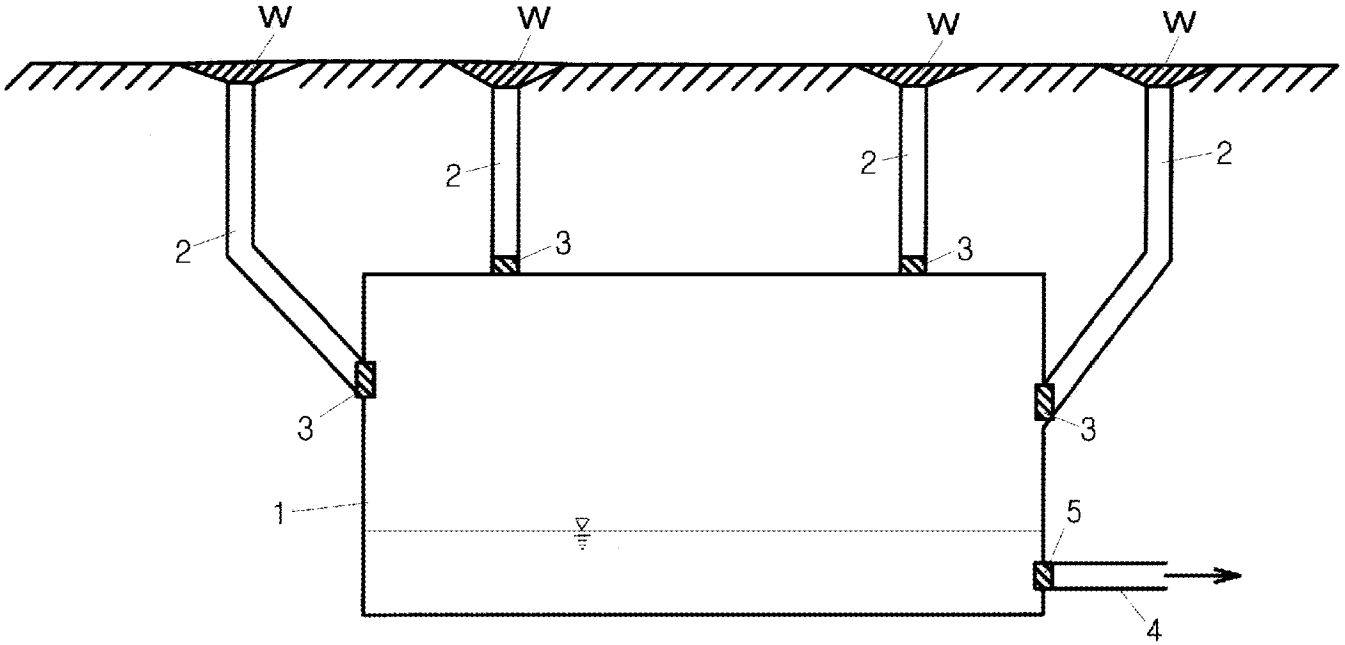
FIG. 1 is a vertical cross-sectional view conceptionally showing one embodiment of a secondary drainage method for use at the time of flooding according to the present invention.

FIG. 1 conceptionally shows one embodiment of a secondary drainage method for use at the time of flooding, wherein in a region where it is known, from experiences or from topography or geological stratum conditions, that flooding of land or of property remains locally even after wide-area flooding of land due to a localized severe rain storm, river flooding or the like has receded, a rainwater storage tank 1 is provided, drainage pipes 2 are installed between positions in which flooding of land or of property occurs and the rainwater storage tank, and inflow switching valves are installed in portions where water flows in from the drainage pipes 2 to the rainwater storage tank 1.

As a general rule, the flow of water into the rainwater storage tank 1 is prevented by switching the inflow switching valves 3 during the initial stages of a localized severe rain storm or of river flooding that occurs in a target region. In which case, however, depending on the scale of wide-area flooding that is anticipated to occur in surrounding areas of the target region, the flow of water into the rainwater storage tank is partly permitted for contribution to suppression of wide-area flooding as well.

After the wide-area flooding of land due to the river flooding or localized severe rain storm has receded, the inflow switching valves 3 are opened, guiding the water in the locally remaining zones of flooded land or of flooded property into the rainwater storage tank 1, resulting in that it is possible to eliminate, at an early stage, the localized flooding of land or of property that remains for a long time and has thus caused some difficulties in the daily lives of local residents.

The rainwater storage tank 1 drains the water toward a sewerage or toward a river or the like using a drainage means passing through a drainage channel 4. In this case, it may be possible also to use a forcible drainage means using a drainage pump 5 or the like.

Figure 2:
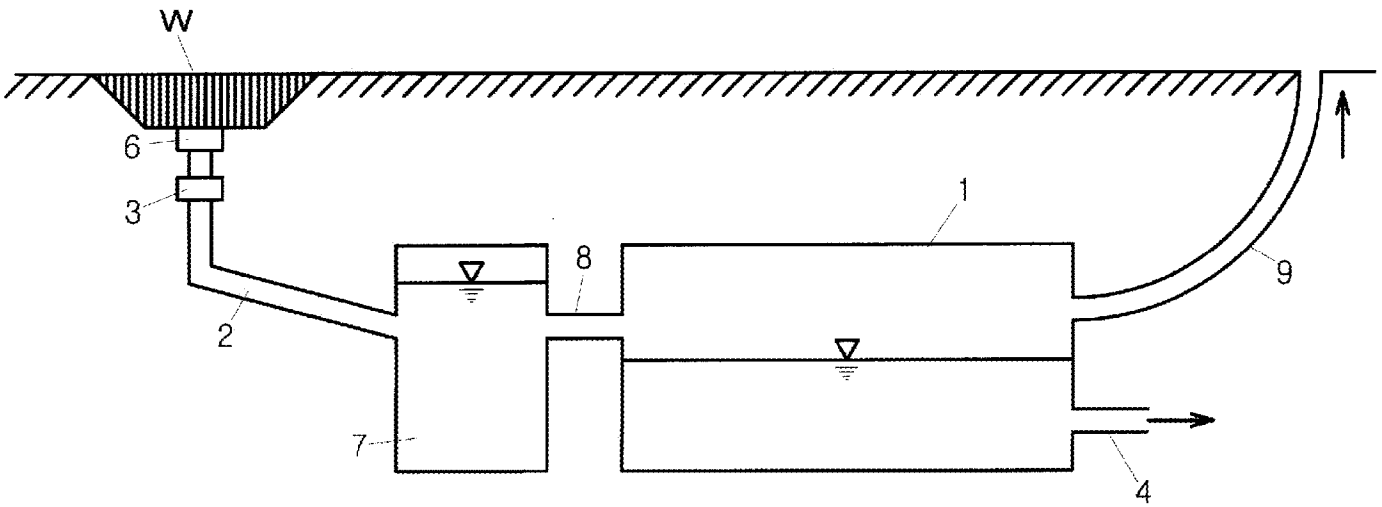
FIG. 2 is a vertical cross-sectional view conceptionally showing another embodiment of the secondary drainage method for use at the time of flooding according to the present invention.

FIG. 2 conceptionally shows another embodiment of the secondary drainage method for use at the time of flooding according to the present invention. In this embodiment, similarly to the case of a conventional rainwater storage tank 1, a filter tank 7 serving as a filter means is provided in the front of the rainwater storage tank 1, wherein after a soil component is once settled in the filter tank 7, the water with earth and sand removed therefrom is introduced into the rainwater storage tank 1 through a connection pipe 8.

However, because of the fact that floodwater remaining even after flooding is in the state of surface water with the soil component settled to a certain degree as compared with muddy water or the like generated immediately after flooding, it is possible to cope with the remaining floodwater by use of a more simplified rainwater storage tank compared with a common type of rainwater storage tank 1.

Further, in this embodiment, in a portion where it is known that the flooding of land remains, a drain 6 is provided, and the inflow switching valve is installed in the vicinity of the drain. The water stored in the rainwater storage tank 1 is drained toward the sewerage or toward the river through the drainage channels 4, 9.

EXPLANATION OF REFERENCE NUMERALS

1 . . . Rainwater storage tank, 2 . . . Drainage pipe, 3 . . . Inflow switching valve, 4 . . . Drainage channel, 5 . . . Drainage pump, 6 . . . Drain, 7 . . . Filter tank, 8 . . . Connection pipe, 9 . . . Drainage channel

The invention claimed is:

1. A secondary drainage method for draining at a time of flooding, the method comprising a secondary drainage system that comprises a rainwater storage tank having inflow switching valves installed in water flowing-in portions to temporarily prevent water from flowing in from said water flowing-in portions, a drainage pipe for guiding, into said rainwater storage tank, the water in locally remaining zones of flooded land or of flooded property even after wide-area flooding of land due to a localized severe rain storm or river flooding has receded, and a drainage channel or drainage pump for draining the water stored in said rainwater storage tank, comprising the steps of: preventing the flow of water into said rainwater storage tank by closing said inflow switching valves during initial stages of river flooding or of localized severe rain storm that occurs in a target region, opening said inflow switching valves and guiding the water in locally remaining zones of flooded land or of flooded property into said rainwater storage tank after the wide-area flooding of land due to the river flooding or localized severe rain storm has receded, and draining the water stored in said rainwater storage tank by the drainage channel or drainage pump.

2. A secondary drainage method for draining at a time of flooding, the method comprising a secondary drainage system that comprises a rainwater storage tank having inflow switching valves installed in water flowing-in portions to temporarily prevent water from flowing in from said water flowing-in portions, a drainage pipe for guiding, into said rain water storage tank, the water in locally remaining zones of flooded land or of flooded property even after the wide-area flooding of land due to river flooding or a localized severe rain storm has receded, and a drainage channel or drainage pump for draining the water stored in said rainwater storage tank, comprising the steps of: partly permitting while suppressing the flow of water into said rainwater storage tank by switching said inflow switching valves during initial stages of the river flooding or of localized severe rain storm that occurs in a target region, opening said inflow switching valves and guiding the water in the locally remaining zones of flooded land or of flooded property into said rainwater storage tank after the wide-area flooding of land due to the river flooding or localized severe rain storm has receded, and draining the water stored in said rainwater storage tank by the drainage channel or drainage pump.

3. The secondary drainage method for draining at the time of flooding according to claim 1, wherein said rainwater storage tank is provided in a ground.

4. The secondary drainage method for draining at the time of flooding according to claim 1, wherein said drainage pipe or said rainwater storage tank is provided with a filter tank for removing a soil component.

5. The secondary drainage method for draining at the time of flooding according to claim 1, wherein said drainage pipe includes a drainage pipe for interconnecting said rainwater storage tank and said locally remaining zones of flooded land or of flooded property.

6. The secondary drainage method for use at the time of flooding according to claim 1, wherein said drainage pipe has a water suction pump or water sucking hose for sucking the water in said locally remaining zones of flooded land or of flooded property from a ground surface side, and a connection means for interconnecting said water suction pump or water sucking hose and said rainwater storage tank.

7. The secondary drainage method for draining at the time of flooding according to claim 1, wherein said drainage pipe includes a drainage channel connected to a river or to a sewerage.

8. The secondary drainage method for draining at the time of flooding according to claim 1, wherein said drainage pipe includes a drainage pump connected to a river or to a sewerage.

9. The secondary drainage method for draining at the time of flooding according to claim 2, wherein said rainwater storage tank is provided in a ground.

10. The secondary drainage method for use at the time of flooding according to claim 2, wherein said drainage pipe or said rainwater storage tank is provided with a filter tank for reoving a soil component.

11. The secondary drainage method for draining at the time of flooding according to claim 2, wherein said drainage pipe includes a drainage pipe for interconnecting said rainwater storage tank and said locally remaining zones of flooded land or of flooded property.

12. The secondary drainage method for draining at the time of flooding according to claim 2, wherein said drainage pipe has a water suction pump or water sucking hose for sucking the water in said locally remaining zones of flooded land or of flooded property from a ground surface side, and a connection means for interconnecting said water suction pump or water sucking hose and said rainwater storage tank.

13. The secondary drainage method for draining at the time of flooding according to claim 2, wherein said drainage channel or drainage pump includes a drainage channel connected to a river or to a sewerage.

14. The secondary drainage method for draining at the time of flooding according to claim 2, wherein said drainage channel or drainage pump includes a drainage pump connected to a river or to a sewerage.

* * * * *